US008368633B2

(12) United States Patent
Liao et al.

(10) Patent No.: US 8,368,633 B2
(45) Date of Patent: Feb. 5, 2013

(54) PIXEL DATA PREPROCESSING CIRCUIT AND METHOD

(75) Inventors: Tai Shun Liao, Douliu (TW); Po Sheng Shi, Hsinchu (TW); Chao Hui Wu, Lujhu Township, Taoyuan County (TW)

(73) Assignee: Hannstar Display Corp., Taipei (TW)

( * ) Notice: Subject to any disclaimer, the term of this patent is extended or adjusted under 35 U.S.C. 154(b) by 669 days.

(21) Appl. No.: 12/635,802

(22) Filed: Dec. 11, 2009

(65) Prior Publication Data

US 2010/0238104 A1 Sep. 23, 2010

(30) Foreign Application Priority Data

Mar. 18, 2009 (TW) ..... 98108745 A

(51) Int. Cl.
*G09G 3/36* (2006.01)

(52) U.S. Cl. ..... 345/99

(58) Field of Classification Search ..... None
See application file for complete search history.

(56) References Cited

U.S. PATENT DOCUMENTS

| | | | | |
|---|---|---|---|---|
| 7,961,163 | B2 | 6/2011 | Koo et al. | |
| 8,077,166 | B2 | 12/2011 | Yeon | |
| 8,175,146 | B2 * | 5/2012 | Nam et al. | 375/240.01 |
| 2004/0145596 | A1 * | 7/2004 | Yamakawa et al. | 345/690 |
| 2008/0024473 | A1 * | 1/2008 | Hsu et al. | 345/204 |

FOREIGN PATENT DOCUMENTS

| | | | |
|---|---|---|---|
| CN | 101123075 | A | 2/2008 |
| CN | 101334974 | A | 12/2008 |
| CN | 101561889 | A | 10/2009 |
| TW | I282544 | | 6/2007 |

* cited by examiner

*Primary Examiner* — Jason Olson

(57) ABSTRACT

A pixel data preprocessing method includes the steps of: inputting a first frame data into a timing controller; performing a differential operation on the first frame data to generate a first frame differential data; writing the first frame differential data into a frame memory with the timing controller; reading a second frame differential data from the frame memory with the timing controller; performing an inverse differential operation on the second frame differential data to generate a second frame data; comparing the first frame data and the second frame data; and outputting a driving data with the timing controller according to a comparison result of comparing the first frame data and the second frame data. The present invention further provides a pixel data preprocessing circuit.

20 Claims, 5 Drawing Sheets

F

| | | | | | | |
|---|---|---|---|---|---|---|
| 0 | 1 | 0 | 1 | 0 | 1 | 0 |
| 0 | 1 | 0 | 1 | 0 | 1 | 0 |
| 0 | 1 | 0 | 1 | 0 | 1 | 0 |
| 0 | 1 | 0 | 1 | 0 | 1 | 0 |
| 0 | 1 | 0 | 1 | 0 | 1 | 0 |
| 0 | 1 | 0 | 1 | 0 | 1 | 0 |
| 0 | 1 | 0 | 1 | 0 | 1 | 0 |

FIG 2

PIXEL DATA PREPROCESSING CIRCUIT AND METHOD

CROSS REFERENCE TO RELATED APPLICATION

This application claims the priority benefit of Taiwan Patent Application Serial Number 098108745, filed on Mar. 18, 2009, the full disclosure of which is incorporated herein by reference.

BACKGROUND

1. Field of the Invention

This invention generally relates to a data processing circuit and method for a liquid crystal display and, more particularly, to a pixel data preprocessing circuit and method.

2. Description of the Related Art

The operating principle of a liquid crystal display is to control the arrangement of liquid crystal molecules sandwiched between two transparent substrates by adjusting the bias applied to the two transparent substrates thereby correspondingly controlling the amount of penetrated light within each pixel area so as to show images on the display. In recent years, accompanying with the increase of the resolution of liquid crystal displays, the data rate of pixel data is correspondingly increased thereby increasing the access speed of a frame memory to generate serious electromagnetic interference (EMI) problems.

In addition, as the response of liquid crystal molecules following the electric field applied thereto can not keep pace with the change of electric field itself, the liquid crystal display will appear image sticking during displaying dynamic images thereby decreasing the image quality. In order to solve this problem, the field of art has proposed an overdrive method, i.e. a voltage level larger than the desired gray level value is applied to liquid crystal molecules during gray level transition so as to reduce the required time for rearranging liquid crystal molecules. In the meantime, an overdrive lookup table is formed by recording gray level values of a current frame and its previous frame such that an overdrive voltage to be outputted to the source driver can be determined according to the lookup table during gray level transitions. For example, Taiwan Patent No. I282544 discloses an operation apparatus for overdrive and operation method for overdrive that determines an overdrive voltage to be outputted according to an overdrive lookup table.

Please refer to FIG. 1, it shows a conventional overdrive method including the following steps. The timing controller 910 inputs a current pixel data F(N+1,M) to a comparator 911 and a frame memory 920. The timing controller 910 reads a previous pixel data F(N,M) from the frame memory 920. The comparator 911 obtains an overdrive pixel data F'(N+1,M) from the lookup table 930 based on the current pixel data F(N+1,M) and the previous pixel data F(N,M). And the overdrive pixel data F'(N+1,M) is inputted into a source driver 21 and a gate driver 22 of a liquid crystal display 2 so as to display images on a liquid crystal panel 23; wherein the current pixel data F(N+1,M) is the Mth row of pixel data of the (N+1)th frame; the previous pixel data F(N,M) is the Mth row of pixel data of the Nth frame; and the overdrive pixel data F'(N+1,M) is the Mth row of overdrive pixel data of the (N+1)th frame for driving a row of pixels of the liquid crystal panel 23 through the source driver 21.

Please refer to FIG. 2, it shows a distribution of the pixel data of a 7×8 frame F, wherein when the first row of pixel data of the frame F are going to be stored into or read out from the frame memory 920, the storing and reading processes may be started from the most left pixel data of the frame F to the right to sequentially store every pixel data in the first row into the frame memory 920 or to sequentially read every pixel data in the first row from the frame memory 920, i.e. the pixel data will be stored into the frame memory 920 or read out from the frame memory 920 in a sequence of 01010 . . . . The data change between two adjacent pixels will generate electromagnetic interference during accessing the frame memory 920. As mentioned above, with the increase of speed for accessing the frame memory, this kind of electromagnetic interference problem during accessing the frame memory will become more serious.

SUMMARY

The present invention provides a pixel data preprocessing circuit and method, wherein the change frequency of data during accessing a frame memory is reduced by performing a differential operation on two adjacent rows of pixel data of a frame prior to accessing the frame memory thereby reducing the electromagnetic interference generated during accessing the frame memory.

The present invention provides a pixel data preprocessing method including the steps of: inputting a first frame data of a first frame into a timing controller; performing a differential operation on the first frame data to generate a first frame differential data; writing the first frame differential data into a frame memory with the timing controller; reading a second frame differential data from the frame memory with the timing controller; performing an inverse differential operation on the second frame differential data to generate a second frame data of a second frame; comparing the first frame data and the second frame data; and outputting a driving data with the timing controller according to a comparison result of comparing the first frame data and the second frame data.

The present invention further provides a pixel data preprocessing circuit including a differential unit, a frame memory, an inverse differential unit, and a comparator. The differential unit is for performing a differential operation on a first frame data of a first frame to generate a first frame differential data. The frame memory receives the first frame differential data and outputs a second frame differential data. The inverse differential unit is for performing an inverse differential operation on the second frame differential data to generate a second frame data of a second frame. The comparator is for comparing the first frame data and the second frame data and outputting a driving data.

The present invention further provides a pixel data preprocessing circuit including a frame memory, a lookup table, and a timing controller. The frame memory is for storing frame data. The lookup table stores a plurality of overdrive data. The timing controller receives a first frame data, performs a differential operation on two adjacent rows of pixel data of the first frame data to generate a first frame differential data and writes the first frame differential data into the frame memory. The timing controller also reads a second frame differential data from the frame memory, performs an inverse differential operation on two adjacent rows of pixel data of the second frame differential data to generate a second frame data, and compares the first frame data and the second frame data with the lookup table to output a corresponding overdrive data.

In the pixel data preprocessing circuit and method of the present invention, since a frame data generally has the characteristic of smoothed data distribution, most higher bits in the pixel data processed by the differential operation will become zero-level (i.e. low) and only a few low order bits are at high level. In this manner, adjacent pixels may have lower change frequency of data and the electromagnetic interference problem during accessing the pixel data of a frame memory can be reduced.

BRIEF DESCRIPTION OF THE DRAWINGS

Other objects, advantages, and novel features of the present invention will become more apparent from the following detailed description when taken in conjunction with the accompanying drawings.

FIG. 2 shows a distribution of the pixel data of a frame.

DETAILED DESCRIPTION OF THE EMBODIMENT

It should be noticed that, wherever possible, the same reference numbers will be used throughout the drawings to refer to the same or like parts.

Figure 1:
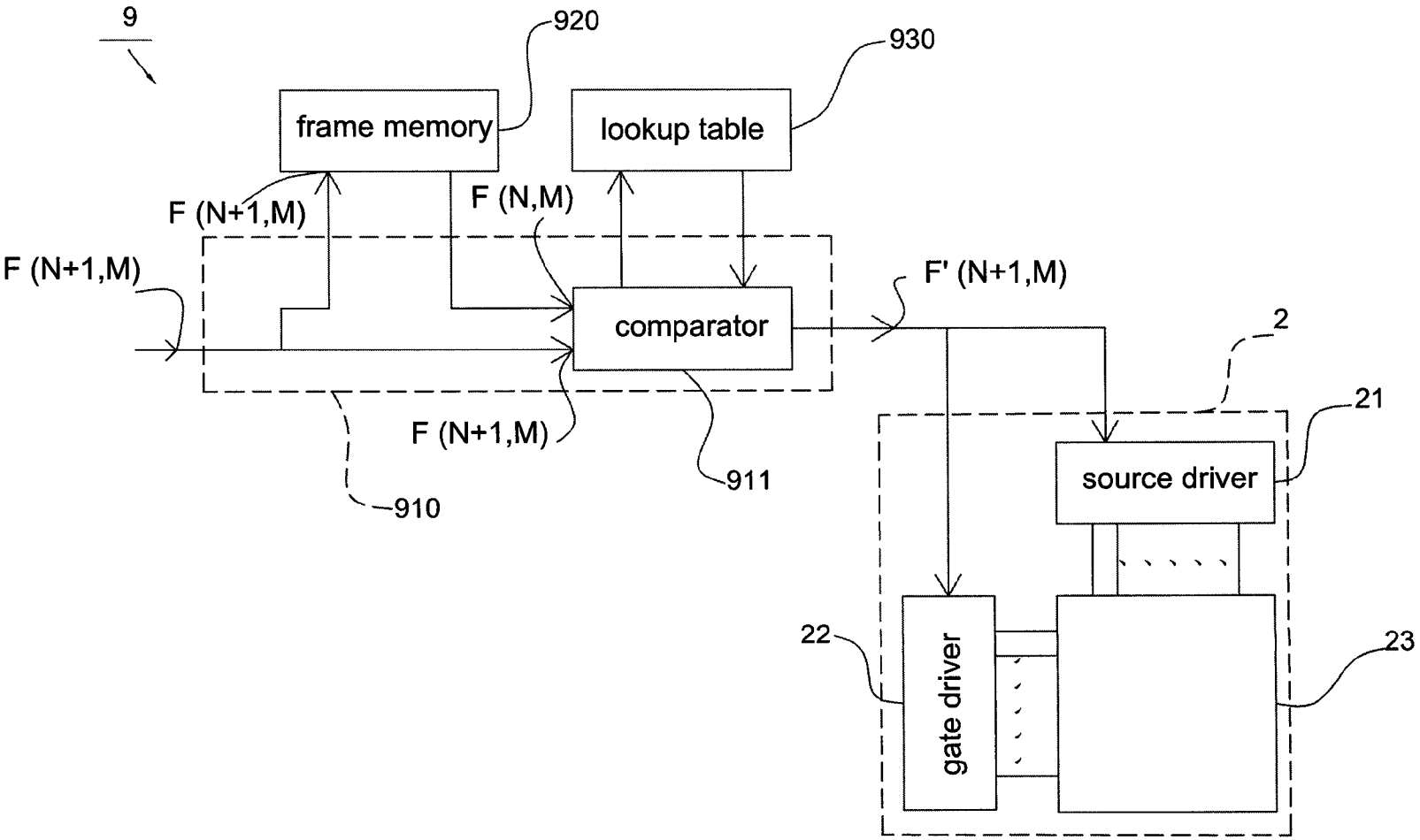
FIG 1 (PRIOR ART)
FIG. 1 shows a block diagram of a conventional pixel data preprocessing circuit.
Figure 3:
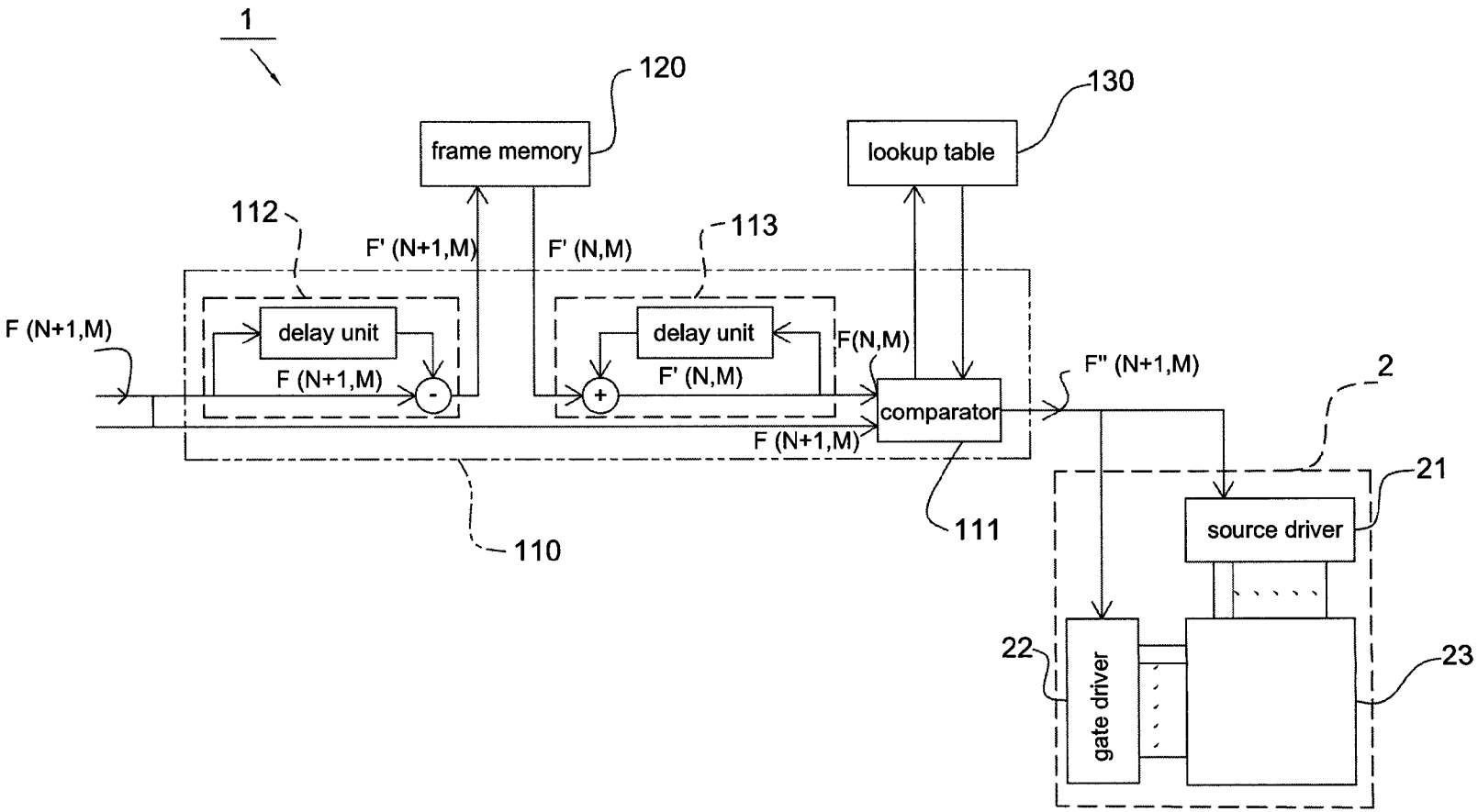
FIG. 3 shows a block diagram of the pixel data preprocessing circuit in accordance with an embodiment of the present invention.

Please refer to FIG. 3, it shows a pixel data preprocessing circuit 1 in accordance with an embodiment of the present invention. The pixel data preprocessing circuit 1 includes a timing controller 110, a frame memory 120 and a lookup table 130. The preprocessing circuit 1 is coupled to a liquid crystal display 2, which includes a source driver 21, a gate river 22 and a liquid crystal panel 23. It could be understood that, FIG. 3 only shows the components for illustrating the present invention and omits other components.

The preprocessing circuit 1 is for processing frame data to generate overdrive pixel data. For example, the preprocessing circuit 1 may sequentially process a row of pixel data of a frame and generate overdrive gray levels of one row of pixels. The frame memory 120 is for storing at least one frame data. A plurality of overdrive data are stored in the lookup table 130 and the overdrive data are preset according to the relative relationship of pixel data between two successive frames.

In the liquid crystal display 2, the gate driver 22 is for generating a scan signal to sequentially turn on every row of pixels (not shown) of the liquid crystal panel 23. The source driver 21 receives the overdrive pixel data from the preprocessing circuit 1 and drives all pixels turned on by the scan signal according to the overdrive pixel data.

Figure 4:
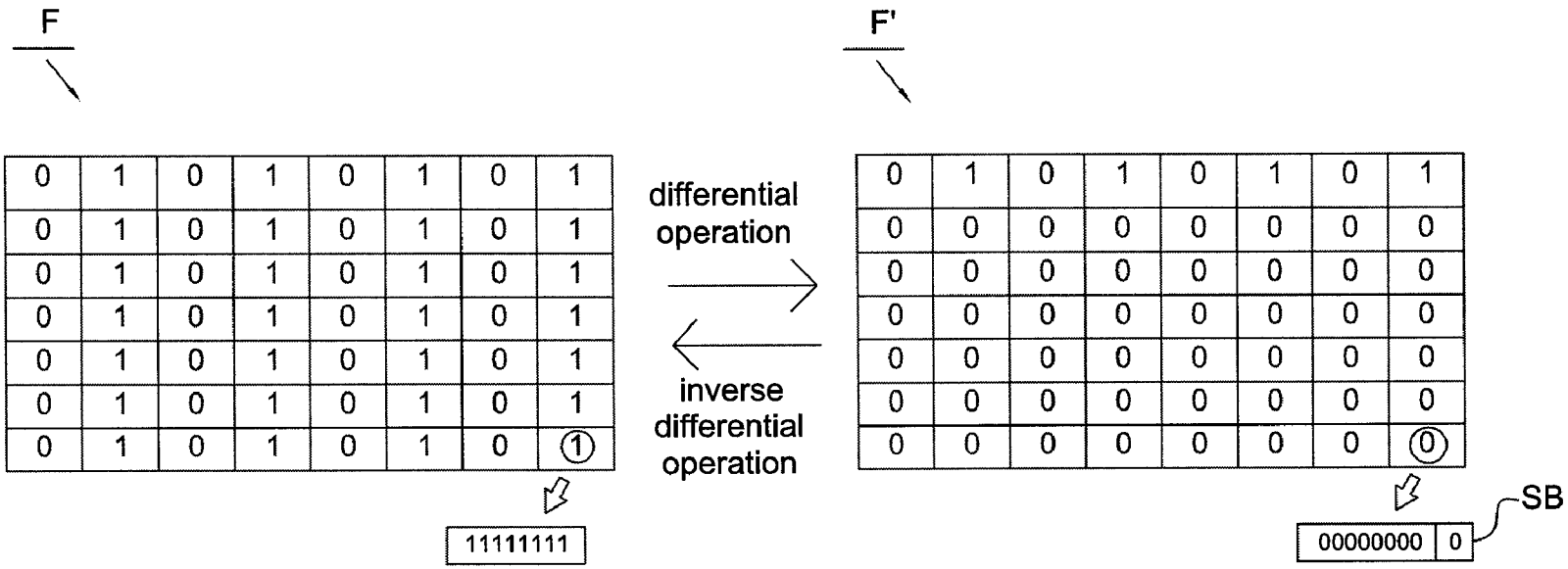
FIG. 4 shows a schematic diagram of the differential operation and inverse differential operation according to the embodiment of the present invention.

Please refer to FIGS. 3 and 4. FIG. 4 shows a schematic diagram of the differential operation and inverse differential operation according to the embodiment of the present invention. In this embodiment, it is assumed that the preprocessing circuit 1 processes a row of pixel data at a time. A first frame data F(N+1,M) of a first frame F(N+1) is inputted into the preprocessing circuit 1 to be preprocessed, wherein F(N+1, M) refers to the Mth row of data of the (N+1)th frame. It is further assumed herein that the first row of data F(N+1,1) to the (M−1)th row of data F(N+1,M−1) of the first frame F(N+1) and the Mth row of data F(N,M) to the seventh row of data F(N,7) of the second frame F(N) have been already stored in the frame memory 120, wherein the second frame F(N) is the immediately previous frame of the first frame F(N+1). It should be understood that, although FIG. 3 illustrates with a 7×8 frame, it is not used to limit the present invention. The frames F and F' may have different sizes according to different embodiments.

The timing controller 110 includes a comparator 111, a differential unit 112 and an inverse differential unit 113. The differential unit 112 includes a delay unit and a subtractor for performing a differential operation on the first frame data F(N+1,M) to generate a first frame differential data F'(N+1, M). Please refer to FIG. 4, when the first frame data F(N+1,1) is inputted into the timing controller 110, the delay unit of the differential unit 112 delays the first frame data F(N+1,1) for a period of time, and the delayed time period may be determined according to the data rate. Because the first frame data F(N+1,1) is the first row of pixel data of the first frame F(N+1), the subtractor subtracts 0 from the first frame data F(N+1,1) to obtain the first frame differential data F'(N+1,1). In can be seen from the figure that, the first frame data F(N+1,1) is equal to the first frame differential data F'(N+1,1) at this moment. In addition, the differential unit 112 further adds a sign bit "SB" to each pixel, wherein when the sign bit "SB" is positive, it means that the first frame data F(N+1,1) is positive; and when the sign bit "SB" is negative, it means that the first frame data F(N+1,1) is negative. However, the meaning represented by the setting of the sign bit "SB" may be reversed. For example, in the pixel data with 256 gray levels, the first frame data F(N+1,M) may have 8 bits and the first frame differential data F(N+1,M) may have 9 bits (including a sign bit "SB"). Next, when the first frame data F(N+1,2) is inputted into the timing controller 110, the delay unit of the differential unit 112 delays the first frame data F(N+1,2) for a period of time, and the subtractor performs a subtraction operation between the first frame data F(N+1,2) and F(N+1, 1) to obtain a first frame differential data F'(N+1,2) and adds a sign bit "SB" thereto. Then, the rest first frame data F(N+1,M) will be sequentially inputted into the timing controller 110, and the differential unit 112 will generate corresponding first frame differential data F'(N+1,M). The timing controller 110 sequentially writes the first frame differential data F(N+1,M) into the frame memory 120. Because a frame data generally has the characteristic of smoothed data distribution, most higher order bits of each pixel of the first frame differential data F'(N+1,M) become zero level and only a few low order bits are still at high level. In this manner, adjacent pixels may have lower change frequency of data (as the F' shown in FIG. 4) and the electromagnetic interference problem during accessing the frame memory 120 can be reduced.

The timing controller 110 reads a second frame differential data F'(N,M) from the frame memory 120. The inverse differential unit 113 receives the second frame differential data F'(N,M) and performs an inverse differential operation thereon to generate a second frame data F(N,M), which refers to the Mth row of pixel data of the Nth frame. The inverse differential unit 113 includes a delay unit and an adder. The delay unit delays the second frame differential data F'(N,M) for a period of time, and the adder performs an addition operation between the second frame differential data F'(N,M) and an immediately previous row of pixel data F'(N,M−1) of the second frame differential data F'(N,M) to obtain the second frame data F(N,M). In addition, the inverse differential unit 113 has to take into account the sign bit "SB" during performing the inverse differential operation on the second frame differential data F'(N,M) so as to correctly generate the second frame data F(N,M).

The comparator 11 compares the first frame data F(N+1, M) and the second frame data F(N,M) to output a overdrive data F''(N+1,M) to the liquid crystal display 2, which drives the arrangement of liquid crystal molecules according to the overdrive data F"(N+1,M). The overdrive data corresponding to the relationship of pixel gray level between two successive frames have been previously stored in the lookup table 130, and the comparator 111 searches proper overdrive data in the lookup table 130 according to the first frame data F(N+1,M) and the second frame data F(N,M).

Figure 5:
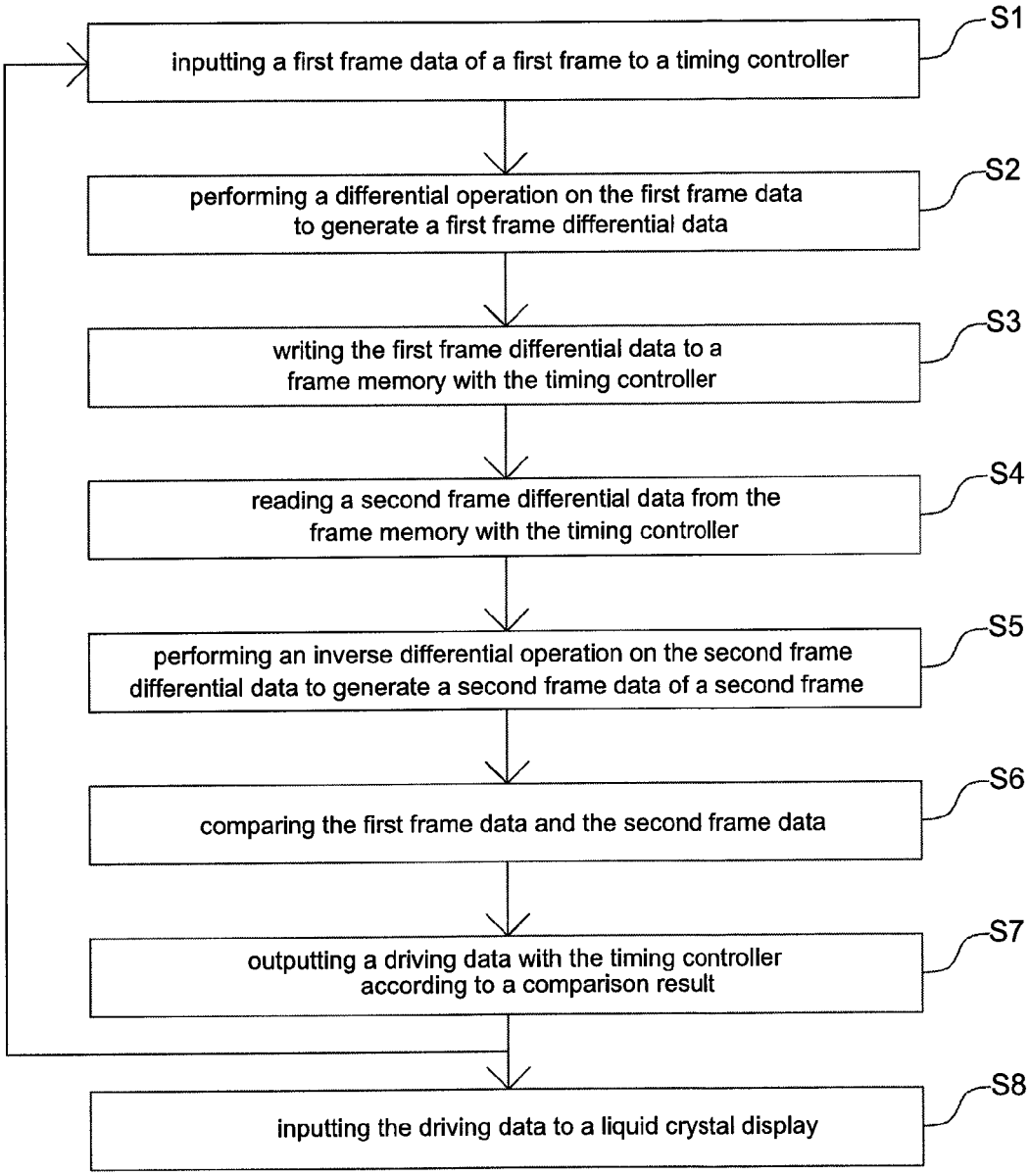
FIG. 5 shows a flow chart of the pixel data preprocessing method in accordance with an embodiment of the present invention.

Please refer to FIG. 5, it shows the pixel data preprocessing method according to the embodiment of the present invention including the steps of: inputting a first frame data of a first frame to a timing controller (Step S1); performing a differential operation on the first frame data to generate a first frame differential data (Step S2); writing the first frame differential data into a frame memory with the timing controller (Step S3); reading a second frame differential data from the frame memory with the timing controller (Step S4); performing an inverse differential operation on the second frame differential data to generate a second frame data of a second frame (Step S5); comparing the first frame data and the second frame data (Step S6); outputting a driving data with the timing controller according to a comparison result of comparing the first frame data and the second frame data (Step S7); and inputting the driving data to a liquid crystal display (Step S8). Details of the pixel data preprocessing method of the present invention have been described in FIG. 3 and its corresponding illustrations, and thus will not be repeated herein.

As mentioned above, as the data rate of pixel data has been quickly increased with the increase of the resolution of liquid crystal displays, high access speed of the frame memory generates serious electromagnetic interference problem. By using the pixel data preprocessing circuit and method of the present invention (as shown in FIGS. 3 to 5), the change frequency of data during accessing a frame memory can be significantly reduced thereby reducing the generated electromagnetic interference during accessing the frame memory.

Although the invention has been explained in relation to its preferred embodiment, it is not used to limit the invention. It is to be understood that many other possible modifications and variations can be made by those skilled in the art without departing from the spirit and scope of the invention as hereinafter claimed.

What is claimed is:

1. A pixel data preprocessing method, comprising the steps of:

inputting a first frame data of a first frame into a timing controller;

performing a differential operation on the first frame data to generate a first frame differential data;

writing the first frame differential data into a frame memory with the timing controller;

reading a second frame differential data from the frame memory with the timing controller;

performing an inverse differential operation on the second frame differential data to generate a second frame data of a second frame;

comparing the first frame data and the second frame data; and outputting a driving data with the timing controller according to a comparison result of comparing the first frame data and the second frame data.

2. The pixel data preprocessing method as claimed in claim 1, wherein the second frame is the immediately previous frame of the first frame.

3. The pixel data preprocessing method as claimed in claim 1, wherein the first frame data is one row of pixel data of the first frame while the second frame data is one row of pixel data of the second frame.

4. The pixel data preprocessing method as claimed in claim 3, wherein the differential operation is to obtain a difference between two adjacent rows of pixel data of the first frame.

5. The pixel data preprocessing method as claimed in claim 4, wherein in the step of performing a differential operation further comprises the step of: adding a sign bit to each pixel data.

6. The pixel data preprocessing method as claimed in claim 5, wherein the inverse differential operation is performed according to the second frame differential data and the sign bit.

7. The pixel data preprocessing method as claimed in claim 1, wherein the driving data is an overdrive gray level.

8. The pixel data preprocessing method as claimed in claim 1, wherein the step of comparing the first frame data and the second frame data is to compare the first frame data and the second frame data with a lookup table.

9. A pixel data preprocessing circuit, comprising:

a differential unit, for performing a differential operation on a first frame data of a first frame to generate a first frame differential data;

a frame memory, receiving the first frame differential data and outputting a second frame differential data;

an inverse differential unit, for performing an inverse differential operation on the second frame differential data to generate a second frame data of a second frame; and a comparator, for comparing the first frame data and the second frame data and outputting a driving data.

10. The pixel data preprocessing circuit as claimed in claim 9, wherein the second frame is the immediately previous frame of the first frame.

11. The pixel data preprocessing circuit as claimed in claim 9, wherein the driving data is an overdrive gray level.

12. The pixel data preprocessing circuit as claimed in claim 9, further comprising a lookup table for storing the driving data.

13. The pixel data preprocessing circuit as claimed in claim 9, wherein the first frame data is one row of pixel data of the first frame while the second frame data is one row of pixel data of the second frame.

14. The pixel data preprocessing circuit as claimed in claim 13, wherein the differential unit comprises a delay unit and a subtractor.

15. The pixel data preprocessing circuit as claimed in claim 14, wherein the delay unit is for delaying a row of pixel data of the first frame while the subtractor performs a subtraction operation between two adjacent rows of pixel data of the first frame.

16. The pixel data preprocessing circuit as claimed in claim 15, wherein the differential unit further adds a sign bit to each pixel data.

17. The pixel data preprocessing circuit as claimed in claim 13, wherein the inverse differential unit comprises a delay unit and an adder.

18. The pixel data preprocessing circuit as claimed in claim 17, wherein the delay unit is for delaying a row of pixel data of the second frame differential data while the adder performs an addition operation between two adjacent rows of pixel data of the second frame differential data.

19. A pixel data preprocessing circuit, comprising:

a frame memory, for storing frame data;

a lookup table, storing a plurality of overdrive data;

a timing controller, receiving a first frame data, performing a differential operation on two adjacent rows of pixel data of the first frame data to generate a first frame differential data and writing the first frame differential data into the frame memory; reading a second frame differential data from the frame memory and performing an inverse differential operation on two adjacent rows of pixel data of the second frame differential data to generate a second frame data; and comparing the first frame data and the second frame data with the lookup table to output a corresponding overdrive data.

20. The pixel data preprocessing circuit as claimed in claim 19, wherein the second frame is the immediately previous frame of the first frame.

* * * * *